US011131316B2

(12) United States Patent
Kunieda et al.

(10) Patent No.: US 11,131,316 B2
(45) Date of Patent: Sep. 28, 2021

(54) CENTRIFUGAL COMPRESSOR

(71) Applicant: KABUSHIKI KAISHA TOYOTA JIDOSHOKKI, Aichi-ken (JP)

(72) Inventors: Takahito Kunieda, Kariya (JP); Ryosuke Fukuyama, Kariya (JP); Yoshiyuki Nakane, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 64 days.

(21) Appl. No.: 16/715,360

(22) Filed: Dec. 16, 2019

(65) Prior Publication Data

US 2020/0208644 A1 Jul. 2, 2020

(30) Foreign Application Priority Data

Dec. 27, 2018 (JP) ..... JP2018-245851

(51) Int. Cl.

| | |
|---|---|
| ***F04D 29/063*** | (2006.01) |
| ***F04D 29/049*** | (2006.01) |
| ***F04D 17/10*** | (2006.01) |
| ***F04D 29/28*** | (2006.01) |
| ***F04D 25/02*** | (2006.01) |

(Continued)

(52) U.S. Cl.

CPC ..... *F04D 29/063* (2013.01); *F04D 17/10* (2013.01); *F04D 25/06* (2013.01); *F04D 29/049* (2013.01); *F04D 29/284* (2013.01); *F04D 25/02* (2013.01); *F04D 29/059* (2013.01)

(58) Field of Classification Search

CPC ..... F04D 17/10; F04D 29/063; F04D 25/06; F04D 25/028; F04D 25/02; F04D 29/059; F04D 29/284

See application file for complete search history.

(56) References Cited

U.S. PATENT DOCUMENTS

| | | | |
|---|---|---|---|
| 5,605,045 | A | 2/1997 | Halimi et al. |
| 9,982,687 | B2 | 5/2018 | Mitsuda et al. |

(Continued)

FOREIGN PATENT DOCUMENTS

| | | |
|---|---|---|
| CN | 1217764 A | 5/1999 |
| JP | 4-127452 | 11/1992 |

(Continued)

*Primary Examiner* — Peter J Bertheaud

(74) *Attorney, Agent, or Firm* — Greenblum & Bernstein, P.L.C.

(57) ABSTRACT

A centrifugal compressor includes a partition wall that is arranged between a ring member and the bottom of a main body in a speed-increaser chamber. The centrifugal compressor further includes an introduction passage that guides oil in a stirring region to a storage region. The stirring region includes a region between the partition wall and the ring member in the speed-increaser chamber. The storage region includes a region between the partition wall and the bottom of the main body in the speed-increaser chamber. The oil that has been stirred by rotation of the ring member collides the inner circumferential surface of a speed increaser housing before flowing toward the partition wall. The oil is then guided to the storage region via the introduction passage. Since the oil stored in the storage region is unlikely to be stirred by rotation of the ring member, only a small amount of oil is stirred by the ring member.

5 Claims, 4 Drawing Sheets

(51) Int. Cl.
*F04D 29/059* (2006.01)
*F04D 25/06* (2006.01)

(56) References Cited

U.S. PATENT DOCUMENTS

| | | | | |
|---|---|---|---|---|
| 10,746,191 | B2 * | 8/2020 | Fukuyama | F04D 29/059 |
| 10,760,584 | B2 * | 9/2020 | Fukuyama | F04D 29/284 |
| 10,767,655 | B2 * | 9/2020 | Fukuyama | F04D 25/028 |
| 2018/0283387 | A1 * | 10/2018 | Fukuyama | F04D 29/059 |

FOREIGN PATENT DOCUMENTS

| | | | |
|---|---|---|---|
| JP | 2010-053960 | | 3/2010 |
| JP | 2014-228069 | | 12/2014 |
| JP | 2015-140682 | A | 8/2015 |
| JP | 2016-186238 | | 10/2016 |
| JP | 2017-150550 | | 8/2017 |
| JP | 2018-071728 | | 5/2018 |
| WO | WO9711263 | A1 | 3/1997 |

* cited by examiner

CENTRIFUGAL COMPRESSOR

BACKGROUND

1. Field

The present disclosure relates to a centrifugal compressor equipped with a speed increaser.

2. Description of Related Art

A compressor equipped with a speed increaser is disclosed in Japanese Laid-Open Patent Publication No. 2016-186238. The speed increaser includes a ring member, a high-speed shaft, rollers, and a speed-increaser chamber. The ring member rotates as a low-speed shaft rotates. The high-speed shaft is arranged inside the ring member. The rollers are arranged between the ring member and the high-speed shaft and contact both of the ring member and the high-speed shaft. The speed-increaser chamber accommodates the ring member, the high-speed shaft, and the rollers.

In the speed increaser, oil needs to be supplied to contacting sections between the rollers and the ring member and between the rollers and the high-speed shaft to limit wearing and seizure at the contacting sections. The compressor of the above-described publication includes a storage chamber, which is separate from the speed-increaser chamber and stores oil. The compressor uses a pump to supply oil in the storage chamber to the speed-increaser chamber. The oil supplied to the speed-increaser chamber is stirred by rotation of the ring member.

Since the compressor of the above-described publication has the storage chamber on the outer circumferential surface of the housing, the size of the compressor is relatively large. To limit the increase in the size of the compressor, the speed-increaser chamber may be used as the storage chamber. In this case, however, the ring member is submerged in the oil stored in the speed-increaser chamber. This increases the stirring resistance during rotation of the ring member and thus reduces the efficiency of the speed increaser.

SUMMARY

Accordingly, it is an objective of the present disclosure to provide a centrifugal compressor that reduces the stirring resistance during rotation of the ring member.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a centrifugal compressor is provided that includes a low-speed shaft, a ring member, a high-speed shaft, a roller, an impeller, an electric motor, a tubular housing, a partition wall, and an introduction passage. The ring member rotates as the low-speed shaft rotates. The ring member has an annular portion. The high-speed shaft is located inside the annular portion. The roller is arranged between the annular portion and the high-speed shaft to contact both of the annular portion and the high-speed shaft. The impeller rotates integrally with the high-speed shaft. The electric motor rotates the low-speed shaft. The tubular housing includes a speed-increaser chamber, a motor chamber, and a dividing wall. The speed-increaser chamber accommodates the ring member, the roller, and a part of the high-speed shaft, and stores oil. The motor chamber accommodates the electric motor. The dividing wall divides the speed-increaser chamber and the motor chamber from each other. The partition wall is arranged between the ring member and the dividing wall in the speed-increaser chamber. The introduction passage guides oil in a stirring region to a storage region. The stirring region includes a region between the partition wall and the ring member in the speed-increaser chamber. The storage region includes a region between the partition wall and the dividing wall in the speed-increaser chamber.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A centrifugal compressor 10 according to an embodiment will now be described with reference to FIGS. 1 to 4. The centrifugal compressor 10 of the present embodiment includes a speed increaser 60. The centrifugal compressor 10 is mounted on a fuel cell vehicle (FCV), which travels with a fuel cell serving as the power source. The centrifugal compressor 10 supplies air, which is fluid, to the fuel cell.

Figure 1:
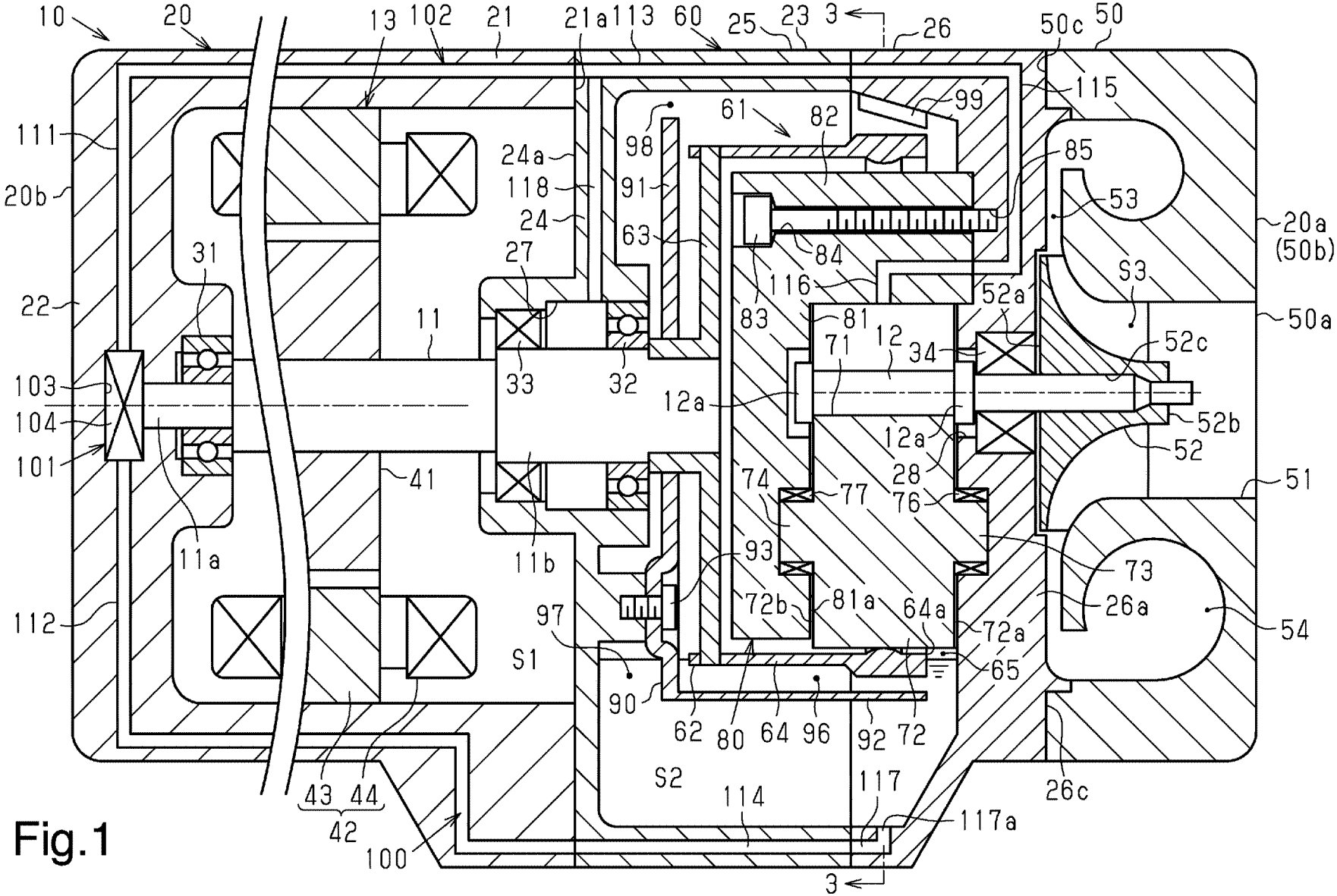
FIG. 1 is a cross-sectional side view illustrating a centrifugal compressor according to an embodiment.

As shown in FIG. 1, the centrifugal compressor 10 includes a low-speed shaft 11, a high-speed shaft 12, an electric motor 13 that rotates the low-speed shaft 11, the speed increaser 60 that increases the speed of rotation of the low-speed shaft 11 and transmits the rotation to the high-speed shaft 12, and an impeller 52 that compresses air by rotation of the high-speed shaft 12. The low-speed shaft 11 and the high-speed shaft 12 are made of metal. For example, the shafts 11, 12 are made of iron or an iron alloy.

The centrifugal compressor 10 includes a housing 20, which accommodates the low-speed shaft 11, the high-speed shaft 12, the electric motor 13, and a speed-increasing mechanism 61, which constitutes a part of the speed increaser 60. The housing 20 is tubular. The housing 20 constitutes the outer shell of the centrifugal compressor 10.

The housing 20 includes a motor housing 21, a speed increaser housing 23, and a compressor housing 50. The motor housing 21 accommodates the electric motor 13. The speed increaser housing 23 accommodates the speed-increasing mechanism 61. The compressor housing 50 has a suction port 50*a*, through which air is drawn in. The housing 20 includes, as end faces in the axial direction of the housing 20, a first end face 20*a* and a second end face 20*b*, which is located on the opposite side to the first end face 20*a*. The suction port 50*a* is provided in the first end face 20*a* of the housing 20. The compressor housing 50, the speed increaser housing 23, and the motor housing 21 are arranged in order in the axial direction of the housing 20 as viewed from the suction port 50*a*. In the present embodiment, the speed-increasing mechanism 61 and the speed increaser housing 23 constitute the speed increaser 60.

The motor housing 21 is tubular and has a bottom 22. The outer surface of the bottom 22 of the motor housing 21 constitutes the second end face 20*b* of the housing 20. The speed increaser housing 23 includes a main body 25, which is tubular and has a bottom 24, and a closing portion 26. The closing portion 26 is provided on the opposite side to the bottom 24 in the axial direction of the main body 25. The closing portion 26 is tubular and has a bottom 26*a*.

The motor housing 21 and the speed increaser housing 23 are coupled to each other with the open end of the motor housing 21 abutting against the bottom 24 of the main body 25. The inner surface of the motor housing 21 and a bottom surface 24*a* of the bottom 24, which faces the motor housing 21, define a motor chamber S1, which accommodates the electric motor 13. The low-speed shaft 11 is accommodated in the motor chamber S1 with the rotation axis direction matching the axial direction of the housing 20.

The low-speed shaft 11 is rotationally supported by the housing 20. The centrifugal compressor 10 includes a first bearing 31. The first bearing 31 is provided in the bottom 22 of the motor housing 21. The low-speed shaft 11 includes a first end section 11*a* and a second end section 11*b* on the opposite side to the first end section 11*a*. The first end section 11*a* of the low-speed shaft 11 is rotationally supported by the first bearing 31.

The bottom 24 of the main body 25 has a shaft insertion hole 27, through which the second end section 11*b* of the low-speed shaft 11 is inserted. A part of the low-speed shaft 11 protrudes into the speed increaser housing 23 through the shaft insertion hole 27. The shaft insertion hole 27 is slightly larger than the second end section 11*b* of the low-speed shaft 11. A second bearing 32 and a first sealing member 33 are arranged in the shaft insertion hole 27. The second bearing 32 rotationally supports the second end section 11*b* of the low-speed shaft 11. The first sealing member 33 seals the gap between the shaft insertion hole 27 and the second end section 11*b* of the low-speed shaft 11. The first sealing member 33 is arranged at a position closer to the motor chamber S1 than the second bearing 32. The first sealing member 33 restricts oil in the speed increaser housing 23 from flowing to the motor chamber S1.

The electric motor 13 includes a rotor 41, which is fixed to the low-speed shaft 11, and a stator 42. The stator 42 is arranged outside the rotor 41 and fixed to the inner circumferential surface of the motor housing 21. The stator 42 has a cylindrical stator core 43 and a coil 44 wound around the stator core 43. Current through the coil 44 causes the rotor 41 and the low-speed shaft 11 to rotate integrally.

The speed increaser housing 23 is assembled with the open end of the main body 25 and the open end of the closing portion 26 abutting against each other. In this state, the inner surface of the closing portion 26 and the inner surface of the main body 25 define a speed-increaser chamber S2, which accommodates the speed-increasing mechanism 61 and stores oil. Thus, the bottom 24 of the main body 25 functions as a dividing wall that divides the speed-increaser chamber S2 and the motor chamber S1 from each other.

The bottom 26*a* of the closing portion 26 has a closing portion through-hole 28. The high-speed shaft 12, which constitutes a part of the speed-increasing mechanism 61, is passed through the closing portion through-hole 28. A part of the high-speed shaft 12 protrudes into the compressor housing 50 through the closing portion through-hole 28. A second sealing member 34 is provided in the closing portion through-hole 28. The second sealing member 34 restricts oil in the speed increaser housing 23 from flowing out into the compressor housing 50.

The compressor housing 50 is tubular. The compressor housing 50 has a compressor through-hole 51, which extends through the compressor housing 50 in the axial direction. The compressor housing 50 includes, as end faces in the axial direction of the compressor housing 50, a first end face 50*b* and a second end face 50*c*, which is on the side opposite to the first end face 50*b*. The first end face 50*b* of the compressor housing 50 constitutes the first end face 20*a* of the housing 20. The opening of the compressor through-hole 51 that is located in the vicinity of the first end face 50*b* of the compressor housing 50 functions as the suction port 50*a*.

The compressor housing 50 and the closing portion 26 are assembled with the second end face 50*c* of the compressor housing 50 abutting against an end face 26*c* of the closing portion 26 that is on the opposite side to the open end. In this state, the inner surface of the compressor through-hole 51 and the end face 26*c* of the closing portion 26 define an impeller chamber S3 that accommodates the impeller 52. The suction port 50*a* is connected to the impeller chamber S3. The compressor through-hole 51 has a constant diameter from the suction port 50*a* to a middle position in the axial direction. The compressor through-hole 51 has the shape of a truncated cone that gradually increases in the diameter from the middle position in the axial direction toward the closing portion 26. Thus, the impeller chamber S3, which is defined by the inner surface of the compressor through-hole 51, generally has the shape of a truncated cone.

The impeller 52 is cylindrical and has a diameter that gradually decreases from a proximal end face 52*a* toward a distal end face 52*b*. The impeller 52 has an insertion hole 52*c*, which extends in the direction of the rotation axis of the impeller 52. The high-speed shaft 12 is passed through the insertion hole 52*c*. The impeller 52 is attached to the high-speed shaft 12 with the part of the high-speed shaft 12 that protrudes into the compressor through-hole 51 inserted into the insertion hole 52*c*. The impeller 52 thus rotates integrally with the high-speed shaft 12. Accordingly, when the high-speed shaft 12 rotates, the impeller 52 rotates, so that the air drawn in through the suction port 50*a* is compressed.

Also, the centrifugal compressor 10 includes a diffuser flow path 53, into which the air compressed by the impeller 52 flows, and a discharge chamber 54, into which the air that has passed through the diffuser flow path 53 flows. The diffuser flow path 53 is continuous with the open end of the compressor housing 50 that faces the closing portion 26. The diffuser flow path 53 is a path defined by the end face 26*c* of the closing portion 26 and the surface of the closing portion 26 that is opposed to the end face 26*c*. The diffuser flow path 53 is arranged outward of the impeller chamber S3 in the radial direction of the high-speed shaft 12 and has an annular shape to surround the impeller 52 (the impeller chamber S3). The discharge chamber 54 is arranged outward of the diffuser flow path 53 in the radial direction of the high-speed shaft 12 and has an annular shape. The impeller chamber S3 is connected to the discharge chamber 54 via the diffuser flow path 53. The air compressed by the impeller 52 passes through the diffuser flow path 53 to be compressed further before being discharged through the discharge chamber 54.

The speed increaser 60 will now be described. The speed increaser 60 of the present embodiment is of a traction drive type (a friction roller type).

Figure 2:
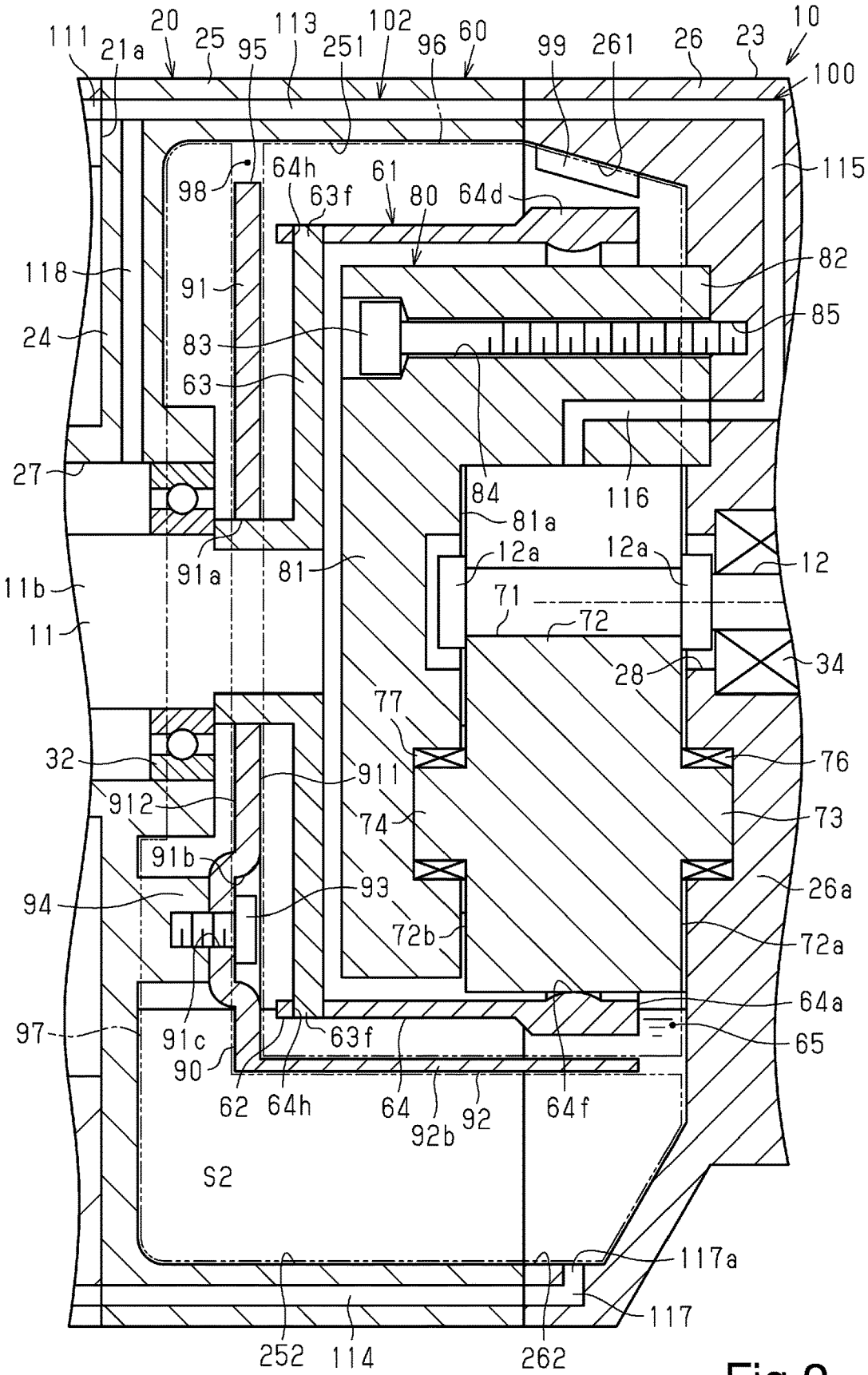
FIG. 2 is an enlarged cross-sectional view illustrating the speed increaser.

As shown in FIG. 2, the speed-increasing mechanism 61 of the speed increaser 60 includes a ring member 62, which is coupled to the second end section 11*b* of the low-speed shaft 11. The ring member 62 includes a disk-shaped base 63, which is coupled to the second end section 11*b* of the low-speed shaft 11, and an annular portion 64. The annular portion 64 extends from the base 63 in a direction away from the low-speed shaft 11. The inner diameter of the annular portion 64 is larger than the diameter of the second end section 11*b* of the low-speed shaft 11.

The annular portion 64 has two insertion holes 64*h*. The insertion holes 64*h* are provided at positions on the opposite sides in the radial direction of the annular portion 64. The insertion holes 64*h* are through-holes that extend through the annular portion 64 in the thickness direction at an end of the annular portion 64 in the vicinity of the base 63. The insertion holes 64*h* are separated by 180 degrees in the circumferential direction of the annular portion 64. The base 63 has two insertion portions 63*f*, which are respectively inserted into the two insertion holes 64*h*. The base 63 is engaged with the annular portion 64 by respectively inserting the two insertion portions 63*f* into the two insertion holes 64*h*.

The ring member 62 is coupled to the low-speed shaft 11 such that the rotation axis direction of the base 63 (the rotation axis direction of the ring member 62) and the rotation axis direction of the low-speed shaft 11 match each other. Accordingly, the base 63 rotates integrally with the low-speed shaft 11. The rotation axis direction of the annular portion 64 also matches the rotation axis direction of the low-speed shaft 11. The two insertion portions 63*f* of the base 63 are respectively inserted into the two insertion holes 64*h* to allow the annular portion 64 rotate integrally with the base 63. The ring member 62 thus rotates as the low-speed shaft 11 rotates.

Part of the high-speed shaft 12 is located inside the annular portion 64. The speed-increasing mechanism 61 includes three rollers 71. The three rollers 71 are arranged between the annular portion 64 and the high-speed shaft 12 to contact both of the annular portion 64 and the high-speed shaft 12. The three rollers 71 have the same shape. Each roller 71 has a columnar roller portion 72, a columnar first protrusion 73, and a columnar second protrusion 74. The roller portion 72 includes, as end faces in the rotation axis direction, a first end face 72*a* and a second end face 72*b*. The first protrusion 73 protrudes from the first end face 72*a* of the roller portion 72. The second protrusion 74 protrudes from the second end face 72*b* of the roller portion 72. All of the rotation axis direction of the roller portion 72, the rotation axis direction of the first protrusion 73, and the rotation axis direction of the second protrusion 74 match one another.

Figure 3:
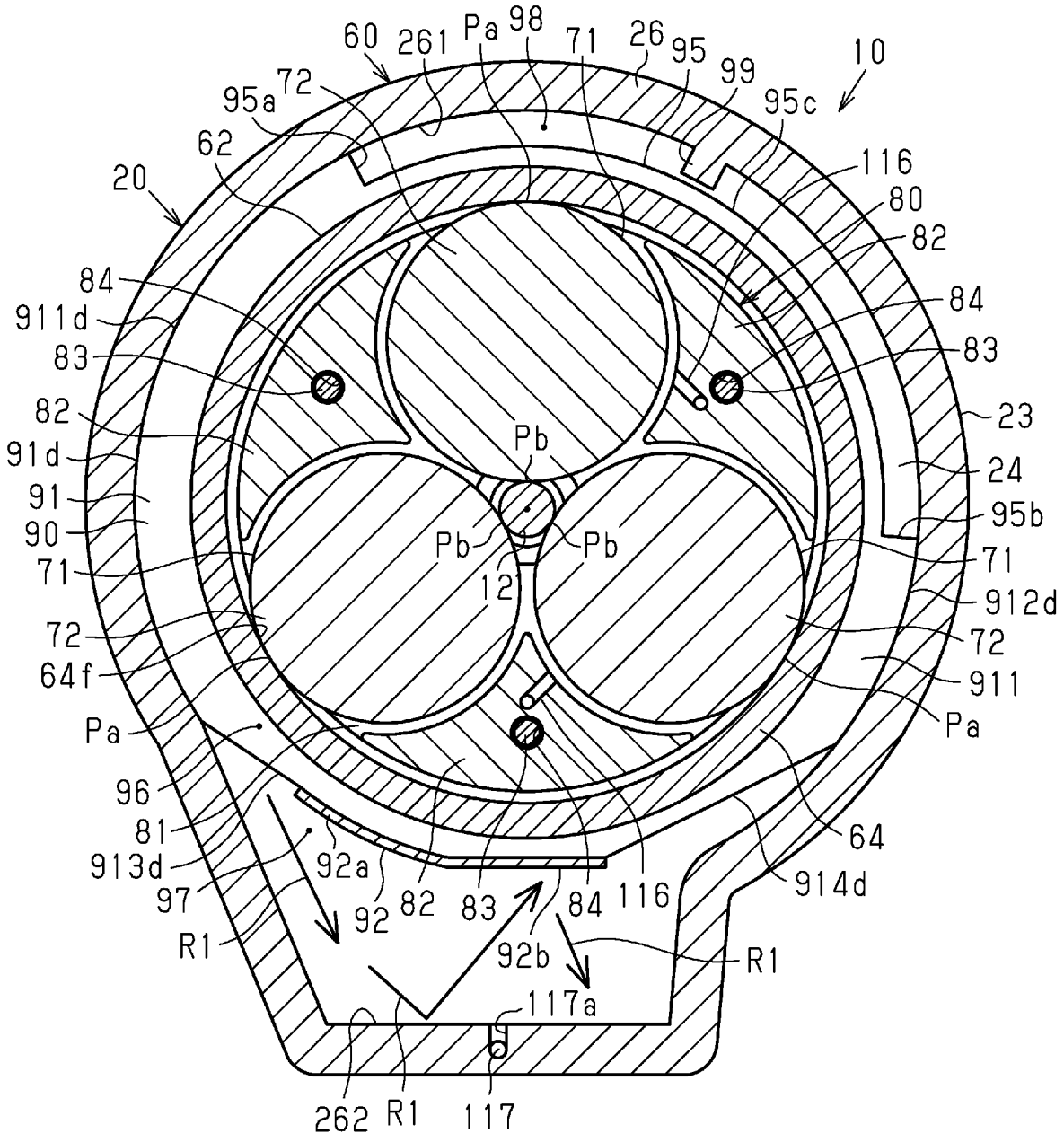
FIG. 3 is a cross-sectional view taken along line 3-3 in FIG. 1.

As shown in FIG. 3, the diameter of each roller portion 72 is larger than the diameter of the high-speed shaft 12. The rotation axis direction of the roller portion 72 also matches the rotation axis direction of the high-speed shaft 12. The rollers 71 are arranged to be separated from each other in the circumferential direction of the high-speed shaft 12. The rollers 71 are made of metal. For example, the roller 71 are made of iron or an iron alloy, which is the same metal as that of the high-speed shaft 12.

As shown in FIG. 2, the annular portion 64 has an annular protuberance 64*f*, which protrudes from the inner circumferential surface of the annular portion 64 toward the three rollers 71. The protuberance 64*f* has a semicircular cross section convex inward in the radial direction of the annular portion 64. That is, the cross section of the protuberance 64*f* has a contour line that extends along an arc. As shown in FIG. 3, the three rollers 71 contact both of the protuberance 64*f* of the annular portion 64 and the outer circumferential surface of the high-speed shaft 12.

As shown in FIG. 2, a section of the annular portion 64 that corresponds to the protuberance 64*f* is a thick section 64*d*, which is thicker than the remaining sections. The thick section 64*d* has a higher stiffness than the remaining sections. This limits radially outward deformation of the annular portion 64 by the reaction force due to the contact between the protuberance 64*f* and the three rollers 71. The thick section 64*d* is located inside the inner circumferential surface of the closing portion 26.

As shown in FIGS. 2 and 3, the speed-increasing mechanism 61 includes a support member 80, which cooperates with the closing portion 26 to rotationally support the rollers 71. The support member 80 is arranged inside the annular portion 64. The support member 80 includes a disk-shaped support base 81, which is slightly smaller than the annular portion 64, and three pillar members 82, which project from the support base 81. The support base 81 is arranged to be opposed to the bottom 26*a* of the closing portion 26 in the rotation axis direction of the roller portions 72. The three pillar members 82 project toward the bottom 26*a* of the closing portion 26 from an opposed surface 81*a* of the support base 81, which is opposed to the bottom 26*a* of the closing portion 26. The three pillar members 82 are arranged so as to fill the three spaces each of which is defined by the inner circumferential surface of the annular portion 64 and the outer circumferential surfaces of the two adjacent roller portions 72.

Each pillar member 82 has a screw insertion hole 84, through which a bolt 83 is passed. The bottom 26*a* of the closing portion 26 has screw holes 85 at positions corresponding to the screw insertion holes 84. The screw holes 85 are connected to the screw insertion holes 84. Each pillar member 82 is arranged such that the screw insertion hole 84 and the screw hole 85 are continuous with each other and that the distal end face of the pillar member 82 abuts against the bottom 26*a* of the closing portion 26. In this state, each pillar member 82 is fixed to the closing portion 26 by inserting a bolt 83 through the screw insertion hole 84 and the screw hole 85 and threading the bolt 83 into the screw hole 85.

As shown in FIG. 2, the speed increaser 60 includes first roller bearings 76 and second roller bearings 77, which rotationally support the rollers 71. The first roller bearings 76 are arranged in the closing portion 26. The second roller bearings 77 are arranged in the support base 81. Each roller 71 is supported by the first roller bearing 76 and the second roller bearing 77 to be arranged between the closing portion 26 and the support base 81.

As shown in FIG. 3, the rollers 71, the ring member 62, and the high-speed shaft 12 are unitized with the roller portions 72 pressed against the high-speed shaft 12 and the annular portion 64. The high-speed shaft 12 is rotationally supported by the three roller portions 72. The contacting section between the outer circumferential surface of each roller portion 72 and the protuberance 64*f* of the annular portion 64 is referred to as a ring-side contacting section Pa. The contacting section between the outer circumferential surface of each roller portion 72 and the outer circumferential surface of the high-speed shaft 12 is referred to as a shaft-side contacting section Pb. Pressing load is applied to the ring-side contacting sections Pa and the shaft-side contacting sections Pb. Each of the contacting sections Pa, Pb extends in the rotation axis direction of the roller portions 72.

As shown in FIG. 1, the high-speed shaft 12 has two flanges 12*a*, which are arranged at positions spaced apart in the rotation axis direction of the high-speed shaft 12. Each roller portion 72 is held between the flanges 12*a*. Accordingly, the high-speed shaft 12 is held such that the position of the high-speed shaft 12 in the rotation axis direction will not be displaced. That is, the high-speed shaft 12 and the roller portions 72 are held such that the relative positions will not be displaced. The speed-increaser chamber S2 accommodates the ring member 62, the three rollers 71, and a part of the high-speed shaft 12.

As shown in FIGS. 2 and 3, most of the inner circumferential surface of the main body 25 is an arcuate surface 251, which extends along the outer circumferential surface of the annular portion 64. The section of the inner circumferential surface of the main body 25 other than the arcuate surface 251 is a bulging surface 252, which bulges outward from the arcuate surface 251. Also, most of the inner circumferential surface of the closing portion 26 is an arcuate surface 261, which extends along the outer circumferential surface of the annular portion 64 as viewed in the axial direction of the closing portion 26. The section of the inner circumferential surface of the closing portion 26 other than the arcuate surface 261 is a bulging surface 262, which bulges outward from the arcuate surface 261. The edge of the arcuate surface 261 on the open side of the closing portion 26 extends along the arcuate surface 251 of the main body 25. Also, the edge of the bulging surface 262 on the open side of the closing portion 26 extends along the bulging surface 252 of the main body 25.

As shown in FIG. 2, with the speed increaser 60 fixed to the closing portion 26, a discharge passage 65 is defined between an end face 64*a* of the annular portion 64 on the open side and the bottom 26*a* of the closing portion 26. The discharge passage 65 connects the inside and the outside of the annular portion 64.

As shown in FIG. 1, the centrifugal compressor 10 includes an oil supplying mechanism 100 configured to supply oil to the speed-increasing mechanism 61. The oil supplying mechanism 100 includes a pump 101 and an oil flow path 102 and operates the pump 101 to circulate oil through the speed-increaser chamber S2 via the oil flow path 102.

The pump 101 is provided in the bottom 22 of the motor housing 21. The pump 101 of the present embodiment is of a displacement type. The pump 101 includes an accommodation portion 103 provided in the bottom 22 and a rotary body 104. The first end section 11*a* of the low-speed shaft 11 is coupled to the rotary body 104.

The motor housing 21 has a first oil passage 111 and a second oil passage 112, which are parts of the oil flow path 102. The first oil passage 111 has a first end, which opens to the accommodation portion 103. The first oil passage 111 also has a second end, which opens in the end face 21*a* at the open end of the motor housing 21. Specifically, the second end of the first oil passage 111 opens in a section that contacts the bottom surface 24*a*. The second oil passage 112 has a first end, which opens to the accommodation portion 103. The second oil passage 112 also has a second end, which opens in the end face 21*a* of the motor housing 21. Specifically, the second end of the second oil passage 112 opens in a section that contacts the bottom surface 24*a*.

The main body 25 has a third oil passage 113 and a fourth oil passage 114, which are parts of the oil flow path 102. The third oil passage 113 and the fourth oil passage 114 open in the opposite end faces in the axial direction of the main body 25. The third oil passage 113 has a first end, which opens at a position in the end face of the main body 25 that faces the first oil passage 111. The first end of the third oil passage 113 is connected to the first oil passage 111. The fourth oil passage 114 has a first end, which opens at a position in the end face of the main body 25 that faces the second oil passage 112. The first end of the fourth oil passage 114 is connected to the second oil passage 112.

The closing portion 26 has two fifth oil passages 115, which are parts of the oil flow path 102. Each fifth oil passage 115 has a first end, which opens at a position in the open end face of the closing portion 26 that faces the third oil passage 113. The first end of each fifth oil passage 115 is connected to the third oil passage 113. Each fifth oil passage 115 has a second end, which opens at a position in the bottom 26*a* that faces the pillar member 82.

The pillar member 82 has two sixth oil passages 116, which are parts of the oil flow path 102. Each sixth oil passage 116 has a first end, which opens at a position in the end face of the pillar member 82 that faces one of the fifth oil passages 115. The first end of the sixth oil passage 116 is connected to the fifth oil passage 115. Each sixth oil passage 116 has a second end, which opens at a position in the outer circumferential surface of the pillar member 82 that faces the roller portion 72. Although not illustrated, the fifth oil passages 115 and the sixth oil passages 116 both branch from the third oil passage 113. The sixth oil passages 116 are provided in two of the three pillar members 82 to supply oil into the ring member 62.

The closing portion 26 has a seventh oil passage 117, which is a part of the oil flow path 102. The seventh oil passage 117 has a first end, which opens at a position in the open end face of the closing portion 26 that faces the fourth oil passage 114. The seventh oil passage 117 has a second end, which opens in the bulging surface 262 of the closing portion 26. The second end of the seventh oil passage 117 is an oil discharging hole 117*a*, which discharges oil in the speed-increaser chamber S2 to the outside of the speed-increaser chamber S2. Thus, the inner circumferential surface of the housing 20 has the oil discharging hole 117*a*, which discharges the oil in the speed-increaser chamber S2 to the outside of the speed-increaser chamber S2.

As shown in FIG. 2, the centrifugal compressor 10 is used with the part of the speed increaser housing 23 connected to the seventh oil passage 117 facing vertically downward. Thus, the bulging surface 252 of the main body 25 and the bulging surface 262 of the closing portion 26 are arranged at the vertically lower portion. The oil discharging hole 117*a* is arranged to face vertically upward. In the speed-increaser chamber S2, oil is stored in a part connected to the oil discharging hole 117*a* under its own weight.

The bottom 24 of the main body 25 has an oil supply passage 118, which branches from the third oil passage 113 to supply oil to a part of the shaft insertion hole 27 between the first sealing member 33 and the second bearing 32. The oil supply passage 118 has a first end, which opens to the third oil passage 113. The oil supply passage 118 has a second end, which opens to a part of the shaft insertion hole 27 between the first sealing member 33 and the second bearing 32.

When the pump 101 operates, oil flows through the oil passages in order of the seventh oil passage 117, the fourth oil passage 114, the second oil passage 112, the accommodation portion 103, the first oil passage 111, the third oil passage 113, the fifth oil passages 115, and the sixth oil passages 116. The oil that flows into the sixth oil passages 116 is supplied into the ring member 62 to lubricate the rollers 71. The oil in the ring member 62 is discharged from the ring member 62 through the discharge passage 65. The oil discharged to the outside of the ring member 62 is stored in the speed-increaser chamber S2.

Some of the oil flowing through the third oil passage 113 flows into the oil supply passage 118. The oil that flows through the supply passage 118 is supplied to a part of the shaft insertion hole 27 between the first sealing member 33 and the second bearing 32 to lubricate the first sealing member 33 and the second bearing 32.

When each roller 71 rotates, a thin film of solidified oil (elastohydrodynamic lubrication (EHL)) is provided at the ring-side contacting section Pa and the shaft-side contacting section Pb. The outer circumferential surface of the roller portion 72 and the inner circumferential surface of the annular portion 64 contact each other with a thin film of oil in between, and the outer circumferential surface of the high-speed shaft 12 and the outer circumferential surface of the roller portion 72 contact each other with a thin film of solidified oil in between. The rotational force of each roller 71 is transmitted to the high-speed shaft 12 via the thin film of solidified oil provided between the outer circumferential surface of the high-speed shaft 12 and the outer circumferential surface of the roller portion 72, so that the high-speed shaft 12 rotates. The annular portion 64 rotates at the same speed as that of the low-speed shaft 11. The rollers 71 rotate at a speed higher than that of the low-speed shaft 11. Further, the high-speed shaft 12, which has a smaller diameter than the roller portions 72, rotates at a higher speed than that of the roller portions 72. As described above, the speed increaser 60 causes the high-speed shaft 12 to rotate at a speed higher than that of the low-speed shaft 11.

Figure 4:
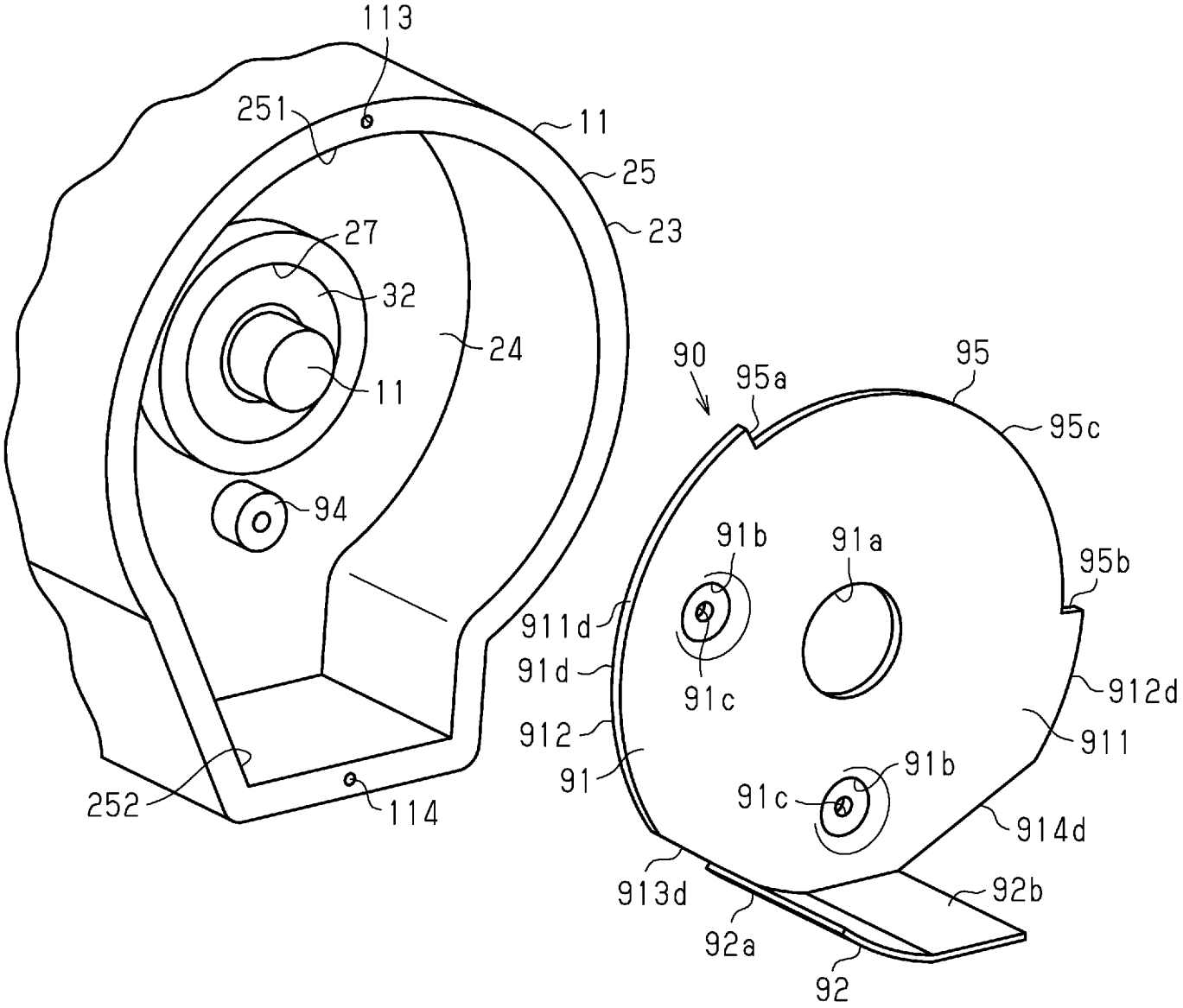
FIG. 4 is an exploded perspective view of a part of the speed increaser housing and the partition wall.

As shown in FIG. 4, the centrifugal compressor 10 includes a partition wall 90, which is arranged between the ring member 62 in the speed-increaser chamber S2 and the bottom 24 of the main body 25. The partition wall 90 includes a thin-disk shaped partition body 91 and a thin plate-shaped projection 92, which projects from a part of the outer circumference of a first end face 911 of the partition body 91. The projecting direction of the projection 92 from the partition body 91 matches thickness direction of the partition body 91.

The partition body 91 has a circular insertion hole 91*a* in the center portion. The insertion hole 91*a* receives an end section of the low-speed shaft 11 that is passed though the shaft insertion hole 27 and protrudes into the speed increaser housing 23. The partition body 91 has two screw accommodating recesses 91*b* in the first end face 911 at positions about the insertion hole 91*a*. The screw accommodating recesses 91*b* are recessed in a direction opposite to the projecting direction of the projection 92. Thus, sections on the first end face 911 of the partition body 91 corresponding to the screw accommodating recesses 91*b* are recessed. In contrast, the sections on a second end face 912 of the partition body 91 corresponding to the screw accommodating recesses 91*b* protrude by the amount corresponding to the recessed amount of the screw accommodating recesses 91*b*. Each screw accommodating recess 91*b* has a screw through-hole 91*c* in the bottom.

As shown in FIG. 2, the main body 25 has cylindrical bosses 94, which project from the bottom 24 and are located about the shaft insertion hole 27. A bolt 93 is passed through each screw through-hole 91*c* of the partition body 91 and screwed into the corresponding boss 94, so that the partition wall 90 is attached to the bottom 24 of the main body 25. The plane direction of the partition body 91 is orthogonal to the axial direction of the main body 25. The projecting direction of the projection 92 from the partition body 91 matches the axial direction of the main body 25.

As shown in FIG. 4, an outer circumferential surface 91*d* of the partition body 91 includes a first arcuate surface 911*d* and a second arcuate surface 912*d*, which extend along the arcuate surface 251 of the main body 25. The first arcuate surface 911*d* and the second arcuate surface 912*d* contact the arcuate surface 251 of the main body 25. The length in the circumferential direction of the first arcuate surface 911*d* is longer than the length in the circumferential direction of the second arcuate surface 912*d*. Specifically, the length in the circumferential direction of the first arcuate surface 911*d* is not shorter than twice the length in the circumferential direction of the second arcuate surface 912*d*. The projection 92 is located between the first arcuate surface 911*d* and the second arcuate surface 912*d* in the circumferential direction of the partition body 91.

The outer circumferential surface 91*d* of the partition body 91 includes a first connection surface 913*d* and a second connection surface 914*d*. The first connection surface 913*d* connects a first end in the circumferential direction of the first arcuate surface 911*d* and the projection 92 to each other. The second connection surface 914*d* connects a first end in the circumferential direction of the second arcuate surface 912*d* and the projection 92 to each other.

The partition body 91 includes a cutout 95 in a part in the outer circumference. The cutout 95 includes a first cutout surface 95*a*, a second cutout surface 95*b*, and a third cutout surface 95*c*. The first cutout surface 95*a* extends radially inward in the partition body 91 from a second end in the circumferential direction of the first arcuate surface 911*d*. The second cutout surface 95*b* extends radially inward in the partition body 91 from a second end in the circumferential direction of the second arcuate surface 912*d*. The third cutout surface 95*c* connects the end of the first cutout surface 95*a* on the side opposite to the first arcuate surface 911*d* to the end of the second cutout surface 95*b* on the side opposite to the second arcuate surface 912*d*. The third cutout surface 95*c* extends along the arcuate surface 251 of the main body 25.

The length in the circumferential direction of the third cutout surface 95*c* is substantially the same as the length in the circumferential direction of the first arcuate surface 911*d*. Thus, the length in the circumferential direction of the third cutout surface 95*c* is longer than the length in the circumferential direction of the second arcuate surface 912*d* and not shorter than twice the length in the circumferential direction of the second arcuate surface 912*d*. The third cutout surface 95*c* is separated from the arcuate surface 251 of the main body 25. The third cutout surface 95*c* is arranged such that the insertion hole 91*a* is arranged between the third cutout surface 95*c* and the projection 92 in the radial direction of the partition body 91.

The projection 92 is arranged, in the radial direction of the annular portion 64, between the annular portion 64 and the set of the bulging surface 252 of the main body 25 and the bulging surface 262 of the closing portion 26. Thus, the cutout 95 is arranged at a position farther from the bulging surface 252 of the main body 25 than the projection 92 and vertically above the projection 92.

The projection 92 includes a first plate portion 92*a*, which has a curved plate shape, and a second plate portion 92*b*, which has a flat plate shape. The first plate portion 92*a* is continuous with the first connection surface 913*d*. The second plate portion 92*b* is continuous with the second connection surface 914*d*. The end of the first plate portion 92*a* that is on the opposite side to the first connection surface 913*d* is continuous with the end of the second plate portion 92*b* that is on the opposite side to the second connection surface 914*d*. The length in the projection direction of the first plate portion 92*a* from the partition body 91 is the same as the length in the projection direction of the second plate portion 92*b* from the partition body 91. The thickness of the first plate portion 92*a* is the same as that of the second plate portion 92*b*.

As shown in FIG. 2, the end of the second plate portion 92*b* on the side opposite to the partition body 91 is located at a position overlapping the oil discharging hole 117*a* in the radial direction of the annular portion 64. Accordingly, the projection 92 is arranged, in the radial direction of the annular portion 64, between the inner circumferential surface of the speed increaser housing 23 and the annular portion 64 and arranged at a position opposed to the oil discharging hole 117*a*.

In the speed-increaser chamber S2, the region that is defined between the partition body 91 and the ring member 62 in the axial direction of the annular portion 64 and between the projection 92 and the ring member 62 in the radial direction of the annular portion 64 will be referred to as a stirring region 96. Also, in the speed-increaser chamber S2, the region that is defined between the partition body 91 and the bottom 24 of the main body 25 in the axial direction of the annular portion 64 and between the projection 92 and the inner circumferential surface of the speed increaser housing 23 in the radial direction of the annular portion 64 will be referred to as a storage region 97.

The stirring region 96 is connected to the storage region 97 between the partition body 91 and the bottom 24 of the main body 25 in the axial direction of the annular portion 64 via the space between the cutout 95 and the arcuate surface 251 of the main body 25. Thus, the space between the cutout 95 and the arcuate surface 251 of the main body 25 forms an introduction passage 98, which guides oil in the stirring region 96 to the storage region 97 between the partition body 91 and the bottom 24 of the main body 25 in the axial direction of the annular portion 64.

The arcuate surface 261 of the closing portion 26 is an inclined surface that is inclined such that, as the distance to the partition body 91 decreases, the arcuate surface 261 is separated progressively away from the annular portion 64 in the radially outward direction of the annular portion 64. The arcuate surface 261 of the closing portion 26 is a part that forms the stirring region 96 in the inner circumferential surface of the speed increaser housing 23. A part of the arcuate surface 261 of the closing portion 26 is opposed to the introduction passage 98 in the axial direction of the speed increaser housing 23. The inclination angle of the arcuate surface 261 of the closing portion 26 is larger than the draft angle required in the manufacture of the closing portion 26 using a mold.

As shown in FIGS. 2 and 3, the speed increaser housing 23 includes a barrier protrusion 99. The barrier protrusion 99 protrudes from the arcuate surface 261 of the closing portion 26 toward the annular portion 64. The barrier protrusion 99 is opposed to the introduction passage 98 in the axial direction of the speed increaser housing 23. As shown in FIG. 2, the barrier protrusion 99 has a distal end face located in the protruding direction from the arcuate surface 261. The distal end face is inclined such that, as the distance to the partition body 91 decreases, the distal end face is separated progressively away from the annular portion 64 in the radially outward direction of the annular portion 64. The distal end face of the barrier protrusion 99 is flat. The barrier protrusion 99 has two side surfaces on the opposite sides in the circumferential direction of the arcuate surface 261. The side surfaces are flat and parallel with each other. The barrier protrusion 99 is located outside the thick section 64*d* of the annular portion 64 in the radial direction of the annular portion 64.

The operation of the present embodiment will now be described.

When the ring member 62 rotates, the annular portion 64 lifts and stirs the oil in the stirring region 96 in the speed-increaser chamber S2. When the oil in the stirring region 96 is stirred by the ring member 62, the oil is slashed outward in the radial direction of the annular portion 64 by the centrifugal force of the ring member 62 to collide the inner circumferential surface of the speed increaser housing 23. Particularly, the thick section 64*d* of the annular portion 64 lifts a greater amount of oil in the stirring region 96 than the remaining sections of the annular portion 64. Accordingly, a great amount of oil collides the arcuate surface 261 of the closing portion 26 at the thick section 64*d* of the annular portion 64.

As described above, the arcuate surface 261 of the closing portion 26 is inclined such that, as the distance to the partition body 91 decreases, the arcuate surface 261 is separated progressively away from the annular portion 64 in the radially outward direction of the annular portion 64. Thus, the oil collected on the arcuate surface 261 of the closing portion 26 is guided toward the partition body 91 by the arcuate surface 261 of the closing portion 26. The oil that has been guided toward the partition body 91 by the arcuate surface 261 of the closing portion 26 flows along the arcuate surface 251 of the main body 25 and is then guided to the storage region 97, which is located between the partition body 91 and the bottom 24 of the main body 25 in the axial direction of the annular portion 64, to be stored in the storage region 97. The oil stored in the storage region 97 is unlikely to be stirred by rotation of the ring member 62. This reduces the absolute quantity of the oil stirred by the ring member 62. As a result, the stirring resistance during rotation of the ring member 62 is reduced.

Further, when the oil in the stirring region 96 is stirred, the oil is splashed outward in the radial direction of the annular portion 64 by the centrifugal force of the ring member 62. Some of the oil rotates together with the annular portion 64 on the radially outer side of the annular portion 64 by the rotation of the ring member 62. Specifically, the oil rotates together with the annular portion 64 in the space between the outer circumferential surface of the annular portion 64 and the set of the arcuate surface 251 of the main body 25 and the arcuate surface 261 of the closing portion 26. Accordingly, the oil flows toward the bulging surface 252 of the main body 25 and the bulging surface 262 of the closing portion 26 as indicated by arrows R1 in FIG. 3. The oil thus may collide the parts surrounding the oil discharging hole 117*a* in the bulging surface 262 of the closing portion 26.

As described above, the projection 92 is arranged, in the radial direction of the annular portion 64, between the annular portion 64 and the set of the bulging surface 252 of the main body 25 and the bulging surface 262 of the closing portion 26. The projection 92 is arranged at a position opposed to the oil discharging hole 117*a* in the radial direction of the annular portion 64. Accordingly, the oil first collides the parts around the oil discharging hole 117*a* in the bulging surface 262 of the closing portion 26 and is then splashed at the parts around the oil discharging hole 117*a* in the bulging surface 262 as indicated by arrows R1 in FIG. 3. Thereafter, the oil collides the projection 92 and is splashed back to be discharged to the outside of the speed-increaser chamber S2 through the oil discharging hole 117*a*. Thus, the oil is not rotated together with the annular portion 64 on the radially outer side of the annular portion 64 again after striking the parts around the oil discharging hole 117*a*. This reduces the absolute quantity of the oil stirred by the ring member 62. As a result, the stirring resistance during rotation of the ring member 62 is reduced further.

In addition, the barrier protrusion 99 protrudes from the arcuate surface 261 of the closing portion 26 toward the annular portion 64. Therefore, although the oil rotates together with the annular portion 64 on the radially outer side of the annular portion 64 by the rotation of the ring member 62, the oil collides the barrier protrusion 99 to flow toward the partition body 91 along the barrier protrusion 99. Then, the oil is guided to the storage region 97 between the partition body 91 and the bottom 24 of the main body 25 in the axial direction of the annular portion 64. This further reduces the absolute quantity of the oil stirred by the ring member 62, thereby further reducing the stirring resistance during rotation of the ring member 62.

The oil is supplied to a part of the shaft insertion hole 27 between the first sealing member 33 and the second bearing 32 from the oil supply passage 118. Thereafter, the oil lubricates the first sealing member 33 and the second bearing 32 before flowing out to the storage region 97 via the space between the second bearing 32 and the low-speed shaft 11. Thus, the oil that contributes to lubrication of the first sealing member 33 and the second bearing 32 and flows out to the speed-increaser chamber S2 does not flow out to the stirring region 96. Therefore, the absolute quantity of the oil stirred by the ring member 62 is not increased, so that the stirring resistance during rotation of the ring member 62 is reduced.

The above described embodiment has the following advantages.

(1) The partition wall 90 is arranged between the ring member 62 and the bottom 24 of the main body 25 in the speed-increaser chamber S2. Further, the centrifugal compressor 10 includes the introduction passage 98, which guides the oil in the stirring region 96 to the storage region 97. When the oil in the stirring region 96 is stirred by rotation of the ring member 62, the oil is splashed outward in the radial direction of the annular portion 64 by the centrifugal force of the ring member 62 to collide the inner circumferential surface of the speed increaser housing 23. Some of the oil that has stricken the inner circumferential surface of the speed increaser housing 23 flows toward the partition wall 90 and is guided to the storage region 97 via the introduction passage 98. The oil stored in the storage region 97 is unlikely to be stirred by rotation of the ring member 62. This reduces the absolute quantity of the oil stirred by the ring member 62. As a result, the stirring resistance during rotation of the ring member 62 is reduced.

(2) When the oil in the stirring region 96 is stirred by the ring member 62, the oil is splashed outward in the radial direction of the annular portion 64 by the centrifugal force of the ring member 62. Some of the oil rotates together with the annular portion 64 on the radially outer side of the annular portion 64 by the rotation of the ring member 62. At this time, the oil may collide the parts around the oil discharging hole 117*a* in the inner circumferential surface of the speed increaser housing 23. As described above, the projection 92 is arranged, in the radial direction of the annular portion 64, between the inner circumferential surface of the speed increaser housing 23 and the annular portion 64. The projection 92 is arranged at a position opposed to the oil discharging hole 117*a* in the radial direction of the annular portion 64. Thus, the oil first collides the parts around the oil discharging hole 117*a* in the inner circumferential surface of the speed increaser housing 23 and is then splashed at the parts around the oil discharging hole 117*a* in the inner circumferential surface of the speed increaser housing 23. Thereafter, the oil collides the projection 92 and is splashed back to be discharged to the outside of the speed-increaser chamber S2 through the oil discharging hole 117*a*. Thus, the oil is not rotated together with the annular portion 64 on the radially outer side of the annular portion 64 again after striking the parts around the oil discharging hole 117*a* in the inner circumferential surface of the speed increaser housing 23. This reduces the absolute quantity of the oil stirred by the ring member 62. As a result, the stirring resistance during rotation of the ring member 62 is further reduced.

(3) The arcuate surface 261 of the closing portion 26 is a part that forms the stirring region 96 in the inner circumferential surface of the speed increaser housing 23. The arcuate surface 261 is an inclined surface that is inclined such that, as the distance to the partition body 91 decreases, the arcuate surface 261 is separated progressively away from the annular portion 64 in the radially outward direction of the annular portion 64. The arcuate surface 261 is also opposed to the introduction passage 98 in the axial direction of the speed increaser housing 23. With this configuration, the oil that has splashed outward in the radial direction of the annular portion 64 by rotation of the ring member 62 collides the arcuate surface 261 and is then guided toward the partition wall 90 by the arcuate surface 261. This allows the oil in the stirring region 96 to be easily guided to the storage region 97 via the introduction passage 98, and thus further reduces the absolute quantity of the oil stirred by the ring member 62. As a result, the stirring resistance during rotation of the ring member 62 is further reduced.

(4) The speed increaser housing 23 includes a barrier protrusion 99. The barrier protrusion 99 protrudes toward the annular portion 64 from the arcuate surface 261 of the closing portion 26 and is opposed to the introduction passage 98 in the axial direction of the speed increaser housing 23. Therefore, although the oil rotates together with the annular portion 64 on the radially outer side of the annular portion 64 by the ring member 62, the oil collides the barrier protrusion 99 to flow toward the partition wall 90 along the barrier protrusion 99. The oil is then guided to the storage region 97 via the introduction passage 98. This further reduces the absolute quantity of the oil stirred by the ring member 62. As a result, the stirring resistance during rotation of the ring member 62 is further reduced.

(5) The bottom 24 of the main body 25 has the oil supply passage 118, which supplies oil to a part of the shaft insertion hole 27 between the first sealing member 33 and the second bearing 32. The oil is supplied to a part of the shaft insertion hole 27 between the first sealing member 33 and the second bearing 32. Thereafter, the oil lubricates the first sealing member 33 and the second bearing 32 before flowing out to the storage region 97 via the space between the second bearing 32 and the low-speed shaft 11. Thus, the oil that contributes to lubrication of the first sealing member 33 and the second bearing 32 and flows out to the speed-increaser chamber S2 does not flow out to the stirring region 96. Therefore, the absolute quantity of the oil stirred by the ring member 62 is not increased. As a result, the stirring resistance during rotation of the ring member 62 is reduced.

(6) When the stirring resistance during rotation of the ring member 62 is reduced as described above, stirring of oil in the speed-increaser chamber S2 is suppressed. This reduces the amount of air trapped in the oil by stirring. As a result, the amount of oil that contributes to lubrication of the rollers 71 is increased.

The above-described embodiment may be modified as follows. The above-described embodiment and the following modifications can be combined as long as the combined modifications remain technically consistent with each other.

The partition wall 90 does not necessarily have the projection 92.

The introduction passage 98 may be a through-hole that extends through the partition body 91.

The circumferential range of the cutout 95 provided in the outer circumference of the partition body 91 may be changed as necessary.

The arcuate surface 261 of the closing portion 26 does not necessarily needs to be an inclined surface, but may be an inner circumferential surface that extends in the axial direction of the speed increaser housing 23.

The projection 92 may have, as a whole, a curved plate shape that extends in the circumferential direction of the annular portion 64.

The first plate portion 92*a* of the projection 92 does not need to have a curved plate shape, but may have a flat plate shape.

The first plate portion 92*a* and the second plate portion 92*b* do not need to be continuous with each other. In this case, the projection 92 includes a first plate portion 92*a* and a second plate portion 92*b* that are discontinuous.

The distal end face of the barrier protrusion 99 does not necessarily configured such that, as the distance to the partition body 91 decreases, the distal end face is separated progressively away from the annular portion 64 in the radially outward direction of the annular portion 64. Instead, the distal end face may be a flat surface that extends in the axial direction of the speed increaser housing 23.

The barrier protrusion 99 does not necessarily need to protrude from the arcuate surface 261. The barrier protrusion 99 may be omitted from the speed increaser housing 23.

The pump 101 does not necessarily need to be incorporated in the centrifugal compressor 10. For example, an external pump located outside the centrifugal compressor 10 may be employed.

The number of the rollers 71 may be changed to, for example, four or five.

The speed increaser 60 may use a wedge effect. In this case, at least one of the rollers is a movable roller that is moved by rotation of the ring member 62.

The centrifugal compressor 10 may be employed in any suitable application to compress any type of fluid. For example, the centrifugal compressor 10 may be employed in an air conditioner to compress refrigerant as fluid. Further, the centrifugal compressor 10 may be mounted on any structure other than a vehicle.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A centrifugal compressor comprising:

a low-speed shaft;

a ring member that rotates as the low-speed shaft rotates, the ring member having an annular portion;

a high-speed shaft that is located inside the annular portion;

a roller that is arranged between the annular portion and the high-speed shaft to contact both of the annular portion and the high-speed shaft;

an impeller that rotates integrally with the high-speed shaft;

an electric motor that rotates the low-speed shaft;

a tubular housing that includes a speed-increaser chamber that accommodates the ring member, the roller, and a part of the high-speed shaft, and stores oil, a motor chamber that accommodates the electric motor, and a dividing wall that divides the speed-increaser chamber and the motor chamber from each other;

a partition wall that is arranged between the ring member and the dividing wall in the speed-increaser chamber; and an introduction passage that guides oil in a stirring region to a storage region, the stirring region including a region between the partition wall and the ring member in the speed-increaser chamber, and the storage region including a region between the partition wall and the dividing wall in the speed-increaser chamber, wherein the partition wall includes:

a disk-shaped partition body; and a projection, which projects from the partition body in a thickness direction of the partition body, wherein the partition body is arranged between the ring member and the dividing wall in an axial direction of the annular portion, and the projection is arranged, in a radial direction of the annular portion, at a position opposed to the annular portion.

2. The centrifugal compressor according to claim 1, wherein an inner circumferential surface of the housing has an oil discharging hole that discharges oil in the speed-increaser chamber to outside of the speed-increaser chamber, and the projection is arranged, in a radial direction of the annular portion, between an inner circumferential surface of the housing and the annular portion and arranged at a position opposed to the oil discharging hole.

3. The centrifugal compressor according to claim 1, wherein at least a part of a portion of an inner circumferential surface of the housing that forms the stirring region is an inclined surface, the inclined surface is inclined such that, as a distance to the partition wall decreases, the inclined surface is separated progressively away from the annular portion in a radially outward direction of the annular portion, and the inclined surface is opposed to the introduction passage in an axial direction of the housing.

4. The centrifugal compressor according to claim 1, wherein the housing includes a barrier protrusion, and the barrier protrusion protrudes toward the annular portion from a part of an inner circumferential surface of the housing at which the stirring region is formed, the barrier protrusion being opposed to the introduction passage in an axial direction of the housing.

5. The centrifugal compressor according to claim 1, wherein the dividing wall has a shaft insertion hole through which the low-speed shaft is inserted, a bearing and a sealing member are arranged in the shaft insertion hole, the bearing rotationally supports the low-speed shaft, the sealing member seals a gap between the shaft insertion hole and the low-speed shaft, the sealing member is arranged at a position closer to the motor chamber than the bearing, and the dividing wall has an oil supply passage that supplies oil to a part of the shaft insertion hole between the sealing member and the bearing.

* * * * *